US010259554B1

(12) United States Patent
Eichinger et al.

(10) Patent No.: US 10,259,554 B1
(45) Date of Patent: Apr. 16, 2019

(54) OUTBOARD MOTOR AND MOUNTING ARRANGEMENT THEREFOR

(71) Applicant: Brunswick Corporation, Mettawa, IL (US)

(72) Inventors: Charles H. Eichinger, Oshkosh, WI (US); Wayne M. Jaszewski, Jackson, WI (US); Donald Anderson, Jr., Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/878,103

(22) Filed: Jan. 23, 2018

(51) Int. Cl.

| | |
|---|---|
| ***B63H 20/06*** | (2006.01) |
| ***B63H 20/12*** | (2006.01) |
| ***B63H 20/00*** | (2006.01) |
| ***B63H 20/14*** | (2006.01) |
| ***B63H 20/32*** | (2006.01) |

(52) U.S. Cl.
CPC ..... *B63H 20/06* (2013.01); *B63H 20/002* (2013.01); *B63H 20/12* (2013.01); *B63H 20/14* (2013.01); *B63H 20/32* (2013.01); *B63B 2758/00* (2013.01)

(58) Field of Classification Search
CPC ..... B63H 20/06; B63H 20/002; B63H 20/12; B63H 20/14; B63H 20/32
See application file for complete search history.

(56) References Cited

U.S. PATENT DOCUMENTS

| | | | |
|---|---|---|---|
| 3,599,594 A | 8/1971 | Taipale | |
| 3,934,537 A | 1/1976 | Hall | |
| 5,443,406 A | 8/1995 | Mondek et al. | |
| 5,487,687 A * | 1/1996 | Idzikowski | F02B 61/045 440/77 |
| 5,846,106 A | 12/1998 | Kumita | |
| 7,244,152 B1 | 7/2007 | Uppgard | |

(Continued)

FOREIGN PATENT DOCUMENTS

| | | |
|---|---|---|
| JP | 2012-25305 A | 2/2012 |

OTHER PUBLICATIONS

Jaszewski et al., "Apparatuses and Methods for Servicing Lubrication in a Lower Gearcase of an Outboard Marine Engine", Unpublished U.S. Appl. No. 15/460,434, filed Mar. 16, 2017.

(Continued)

*Primary Examiner* — Stephen P Avila

(74) *Attorney, Agent, or Firm* — Andrus Intellectual Property Law, LLP

(57) ABSTRACT

An outboard motor has an adapter plate with an upper surface supporting an engine, a lower surface spaced therefrom, and fore and aft sides connecting the upper and lower surfaces. A first pocket is defined in the adapter plate's fore side and a second pocket is defined in its aft side. A midsection housing is coupled to the adapter plate's lower surface and suspends a propulsion unit therebelow. A driveshaft coupling the engine's output shaft to the propulsion unit's propeller shaft extends through the adapter plate. A steering arm, which extends into the first pocket, has a hole through which the driveshaft extends. A mount in the second pocket is located aft of the driveshaft, and the mount's fore side is coupled to the steering arm's aft end by way of connectors. A cover plate attached to the adapter plate's aft side secures the mount within the second pocket.

20 Claims, 9 Drawing Sheets

(56) References Cited

U.S. PATENT DOCUMENTS

| | | | | |
|---|---|---|---|---|
| 7,571,705 | B2 | 8/2009 | Inaba | |
| 8,820,701 | B1 | 9/2014 | Eichinger | |
| 9,205,906 | B1 | 12/2015 | Eichinger | |
| 9,376,195 | B1 | 6/2016 | Jaszewski et al. | |
| 9,463,859 | B1 * | 10/2016 | Cooper, III | B63H 20/32 |
| 9,643,703 | B1 | 5/2017 | Eichinger | |
| 9,776,699 | B1 | 10/2017 | Alby et al. | |
| 9,944,374 | B1 * | 4/2018 | Anderson | B63H 20/002 |
| 2004/0043678 | A1 * | 3/2004 | McCafferty | B63H 20/00 440/49 |

OTHER PUBLICATIONS

Honda Marine, 150 HP four-stroke outboard engine, Model No. BF150, date unknown, Admitted Prior Art.

* cited by examiner

OUTBOARD MOTOR AND MOUNTING ARRANGEMENT THEREFOR

FIELD

The present disclosure relates to outboard motors and to mounting arrangements for mounting outboard motors to the transom of a marine vessel.

BACKGROUND

U.S. Pat. No. 7,244,152 discloses an adapter system provided as a transition structure which allows a relatively conventional outboard motor to be mounted to a pedestal which provides a generally stationary vertical steering axis. An intermediate member is connectable to a transom mount structure having a connector adapted for mounts with central axes generally perpendicular to a plane of symmetry of the marine vessel. Many types of outboard motors have mounts that are generally perpendicular to this configuration. The intermediate member provides a suitable transition structure which accommodates both of these configurations and allows the conventionally mounted outboard motor to be supported, steered, and tilted by a transom mount structure having the stationary vertical steering axis and pedestal-type configuration.

U.S. Pat. No. 8,820,701 discloses a mounting arrangement for supporting an outboard motor with respect to a marine vessel extending in a fore-aft plane. The mounting arrangement comprises first and second mounts that each have an outer shell, an inner wedge concentrically disposed in the outer shell, and an elastomeric spacer between the outer shell and the inner wedge. Each of the first and second mounts extend along a axial direction, along a vertical direction that is perpendicular to the axial direction, and along a horizontal direction that is perpendicular to the axial direction and perpendicular to the vertical direction. The inner wedges of the first and second mounts both have a non-circular shape when viewed in a cross-section taken perpendicular to the axial direction. The non-circular shape comprises a first outer surface that extends transversely at an angle to the horizontal and vertical directions. The non-circular shape comprises a second outer surface that extends transversely at a different, second angle to the horizontal and vertical directions. A method is for making the mounting arrangement.

U.S. Pat. No. 9,205,906 discloses a mounting arrangement for supporting an outboard motor with respect to a marine vessel extending in a fore-aft plane. The mounting arrangement comprises first and second mounts that each have an outer shell, an inner wedge concentrically disposed in the outer shell, and an elastomeric spacer between the outer shell and the inner wedge. Each of the first and second mounts extend along a axial direction, along a vertical direction that is perpendicular to the axial direction, and along a horizontal direction that is perpendicular to the axial direction and perpendicular to the vertical direction. The inner wedges of the first and second mounts both have a non-circular shape when viewed in a cross-section taken perpendicular to the axial direction. The non-circular shape comprises a first outer surface that extends transversely at an angle to the horizontal and vertical directions. The non-circular shape comprises a second outer surface that extends transversely at a different, second angle to the horizontal and vertical directions. A method is for making the mounting arrangement.

U.S. Pat. No. 9,463,859 discloses an outboard motor adapter plate coupling a marine engine to a driveshaft housing and including an upper rim configured to be coupled to a lower surface of a cylinder block of the engine. A lower rim of the adapter plate is configured to be coupled to an upper surface of a sump located in the driveshaft housing. A wall defines a passageway having an inner perimetral surface, and the inner perimetral surface extends from the upper rim to the lower rim. A mounting area is configured for coupling a mount to the adapter plate. A shield covers at least a portion of the inner perimetral surface adjacent the mounting area, so as to at least partially thermally isolate the mount from heated fluid that drains from the cylinder block, through the passageway, and into the sump. A method and a shield for thermal isolation are also described.

U.S. Pat. No. 9,643,703 discloses an arrangement for coupling a vibration isolation mount to an outboard motor. A pocket is formed in a midsection housing of the outboard motor and defines a first concave surface. A cover is configured to be mounted to the midsection housing over the pocket via a plurality of fasteners. The cover defines a second, oppositely concave surface on an inner face thereof. When the cover is mounted to the midsection housing over the pocket, the first concave surface and the second concave surface together form a cavity therebetween for holding a vibration isolation mount therein. One of the first concave surface and the second concave surface has a protrusion that extends into the cavity and contacts the mount held therein upon tightening of the plurality of fasteners to hold the cover over mount in the pocket. A mounting arrangement is also provided.

U.S. Pat. No. 9,776,699 discloses an outboard motor having a drive unit including an engine rotating output shaft and a driveshaft extending along a driveshaft axis and having an upper end coupled in torque-transmitting relationship with the output shaft. A propulsor shaft extends along a propulsor shaft axis and has a first end coupled in torque-transmitting relationship to a lower end of the driveshaft and a second end coupled to a propulsor. The propulsor shaft axis defines a direction of thrust generated by the propulsor. A transom bracket couples the drive unit to the marine vessel. A steering support couples the drive unit to the transom bracket and rotates the drive unit about a steering axis to change a direction of the thrust generated by the propulsor. The steering axis is substantially non-parallel to the driveshaft axis, and is oriented with respect to the driveshaft axis at a given angle of less than 45 degrees.

The above patents are hereby incorporated by reference herein in their entireties. In the event that there is an inconsistency between a definition of a term in the specification as compared to a definition of the term in a cited reference, the term should be interpreted based on the definition in the specification.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

According to one example of the present disclosure, an outboard motor includes an adapter plate having an upper surface configured to support an engine, a lower surface spaced from the upper surface, and a fore side and an aft side connecting the upper surface and the lower surface. A pocket is defined in the adapter plate's aft side. A midsection housing is coupled to the lower surface of the adapter plate and is configured to suspend a propulsion unit therebelow. A driveshaft extends through the adapter plate. The driveshaft has an upper end configured to be coupled to an output shaft of the engine and a lower end configured to be coupled to a propulsion shaft of the propulsion unit. A mount is situated in the pocket. The mount is located aft of the driveshaft. A steering arm has a hole through which the driveshaft extends. A fore side of the mount is coupled to an aft end of the steering arm by way of connectors. A cover plate is attached to the adapter plate's aft side and secures the mount within the pocket.

According to another example of the present disclosure, a mounting arrangement for an outboard motor includes an adapter plate having an upper rim configured to support an engine, a lower rim spaced from the upper rim and configured to be coupled to a midsection housing, and a fore side and an aft side connecting the upper rim and the lower rim. A first pocket is defined in the adapter plate's fore side, and a second pocket is defined in the adapter plate's aft side. The second pocket has an upper surface, a lower surface, two side surfaces, and a fore surface defined by the adapter plate. The first pocket and the second pocket are connected by an aperture in the second pocket's fore surface. A steering arm extends into the first pocket and terminates at an aft end. A mount is situated in the second pocket. A fore side of the mount directly abuts an aft end of the steering arm via the aperture and is attached to the steering arm's aft end by way of connectors. A cover plate is attached to the adapter plate's aft side below the adapter plate's upper rim and secures the mount within the second pocket.

BRIEF DESCRIPTION OF THE DRAWINGS

Examples of mounting arrangements for outboard motors are described with reference to the following Figures. The same numbers are used throughout the Figures to reference like features and like components.

DETAILED DISCLOSURE

In the present description, certain terms have been used for brevity, clarity, and understanding. No unnecessary limitations are to be implied therefrom beyond the requirement of the prior art because such terms are used for descriptive purposes only and are intended to be broadly construed. The different assemblies described herein may be used alone or in combination with other assemblies.

Figure 11:
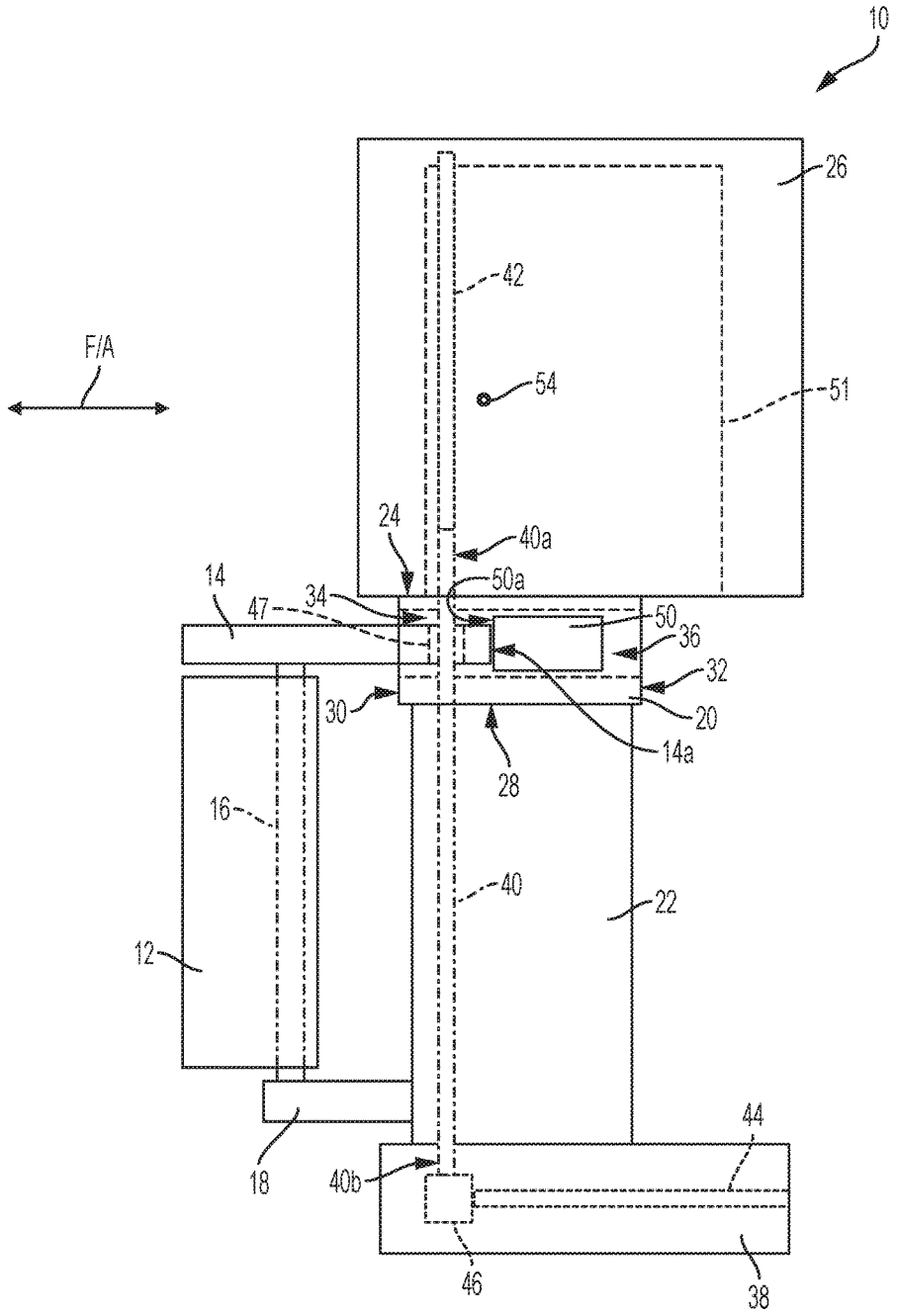
FIG. 11 is a schematic of an outboard motor according to the present disclosure.

FIG. 11 illustrates an outboard motor 10 according to the present disclosure. As is known, the outboard motor 10 is coupled to a transom bracket 12, which is in turn attached to a transom of a marine vessel (not shown) such as by way of clamps and/or bolts. In the embodiment shown herein, the outboard motor 10 is coupled to the transom bracket 12 by way of a steering arm 14 supported by a swivel tube 16 and by way of a lower bracket 18. More specifically, the steering arm 14 is connected to an adapter plate 20 of the outboard motor 10 via an upper mount 50 or mounts, while the lower bracket 18 is connected to a midsection housing 22 of the outboard motor 10 via a lower mount or mounts (not shown).

The adapter plate 20 has an upper surface 24 (see also FIGS. 1 and 10) configured to support an engine 26. The adapter plate 20 also has a lower surface 28 spaced from the upper surface 24, and a fore side 30 and an aft side 32 connecting the upper surface 24 and the lower surface 28. A first pocket 34 is defined in the adapter plate's fore side 30, and a second pocket 36 is defined in the adapter plate's aft side 32. See also FIGS. 2-4 and 9. In another example, only the second pocket 36 is provided, and the adapter plate's fore side 30 is configured other than how is it shown in FIGS. 2-4 and 9.

The midsection housing 22 is coupled to the lower surface 28 of the adapter plate 20 and is configured to suspend a propulsion unit 38 therebelow. A driveshaft 40 extends through the adapter plate 20. The driveshaft 40 has an upper end **40*a* configured to be coupled to an output shaft 42 of the engine 26 and a lower end 40*b* configured to be coupled to a propulsion shaft 44 of the propulsion unit 38. As is known, the connection at the upper end 40*a* of the driveshaft 40 to the output shaft 42 (e.g., crankshaft) of the engine 26 may be made by way of a splined connection. Also as is known, the coupling between the lower end 40*b* of the driveshaft 40 and the propulsion shaft 44 may be made by way of a clutch 46 (e.g., a dog clutch). The propulsion shaft 44 may in turn be connected at its opposite end to any type of propulsor, such as, but not limited to, a propeller, impeller, or the like. The engine 26 powers the propulsor by way of the output shaft 42, driveshaft 40, and propulsion shaft 44**.

According to the present disclosure, the steering arm 14 extends into the first pocket 34 in the adapter plate 20 and terminates at an aft end **14*a*. The steering arm 14 has a hole 47 through which the driveshaft 40 extends. A mount 50 is situated in the second pocket 36. The mount 50 is located aft of the driveshaft 40, and a fore side 50*a* of the mount 50 is coupled to the aft end 14*a* of the steering arm 14 by way of connectors. See, for example, threaded connectors 52*a*, 52*b*, in FIG. 4 and threaded connectors 114*a*, 114*b* in FIG. 9. As will be described further herein below, a cover plate is attached to the adapter plate's aft side 32 and secures the mount 50 within the second pocket 36. The connection of the steering arm 14 to the mount 50 at least in part supports the outboard motor on the transom bracket 12**.

Returning to FIG. 11, in the example shown herein, the engine 26 is a V-shaped engine having a cylinder block 51 that can be attached directly to the upper surface 24 of the adapter plate 20 such as by way of bolts or other fasteners. As is known, the V-shaped cylinder block 51 includes multiple cylinders extending generally horizontally and stacked on top of one another in two cylinder banks, which are angled with respect to one another and with respect to a fore-aft direction F/A of the outboard motor 10. Thus, the cylinder banks form a "V" shape when the engine 26 is viewed from above or below. In the present example, the engine 26 is a four-stroke engine.

During research and development, the present inventors realized that when mounting an outboard motor having a V-shaped engine with other outboard motors on a transom of a single marine vessel, which may allow for only 26 inches between the center axes of each outboard motor, a modified mounting arrangement is required. The 26-inch center-to-center mounting distance between the outboard motors and the motors' wide V-shaped cylinder block bases do not leave much room for placing vibration isolation mounts around each engine's center of gravity 54 on the lateral outside surfaces of the adapter plate 20. Additionally, because the center of gravity 54 of the present four-stroke engine 26 is aft of the output shaft 42 (e.g., four inches aft of the crankshaft's centerline), the present inventors realized that the vibration isolation mounts should be provided further aft with respect to the engine 26 to provide better performance. However, there are space constraints involved with providing mounts on the present four-stroke engine 26, because the oil sump 68 and mount 56 are located in generally the same area of the outboard motor 10 (see FIG. 3). Finally, structural requirements for the outboard motor 10 also dictate fasteners that connect the midsection housing 22 to the cylinder block 51 through the adapter plate 20.

Referring back to FIG. 11, the present design, meant to rectify the above-noted problems, is of a mounting assembly including a mount 50 that is installed in the adapter plate 20 from the aft side of the outboard motor 10, and which is easily accessible from the aft side of the outboard motor 10 for purposes of servicing and/or replacement thereof. The mount 50 is located behind the driveshaft 40, and the steering arm 14 is connected to the fore side 50*a* of the mount 50 and extends forward toward the transom bracket 12. The steering arm 14 has the noted hole 47 that the driveshaft 40 passes through, in order to lessen the width of the outboard motor 10 and thereby accommodate the above-noted space constraints associated with mounting multiple outboard motors on a single vessel. Such a design allows the mount 50 to be serviced without removing the engine 26 and allows fasteners to connect the cylinder block 51 to the midsection housing 22 for improved structural strength. Specific examples of the mounting assembly are described herein below with respect to FIGS. 1-10. A first embodiment of the mount 50 is provided at 56, FIGS. 1-6, while a second embodiment of the mount 50 is provided at 112*a*, 112*b*, FIGS. 9 and 10.

Figure 1:
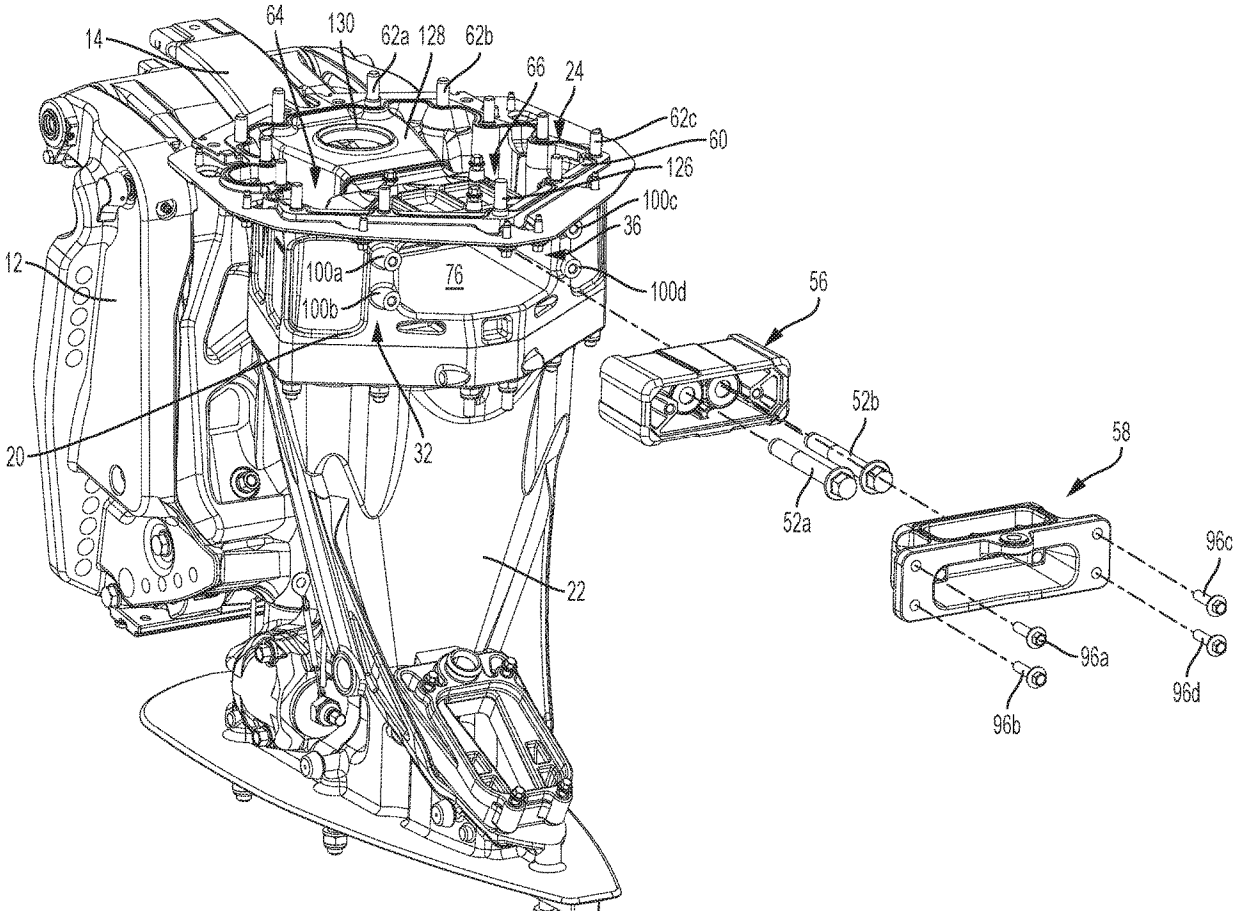
FIG. 1 illustrates a partially exploded view of an outboard motor mounting assembly including an adapter plate, midsection housing, and transom bracket.
Figure 2:
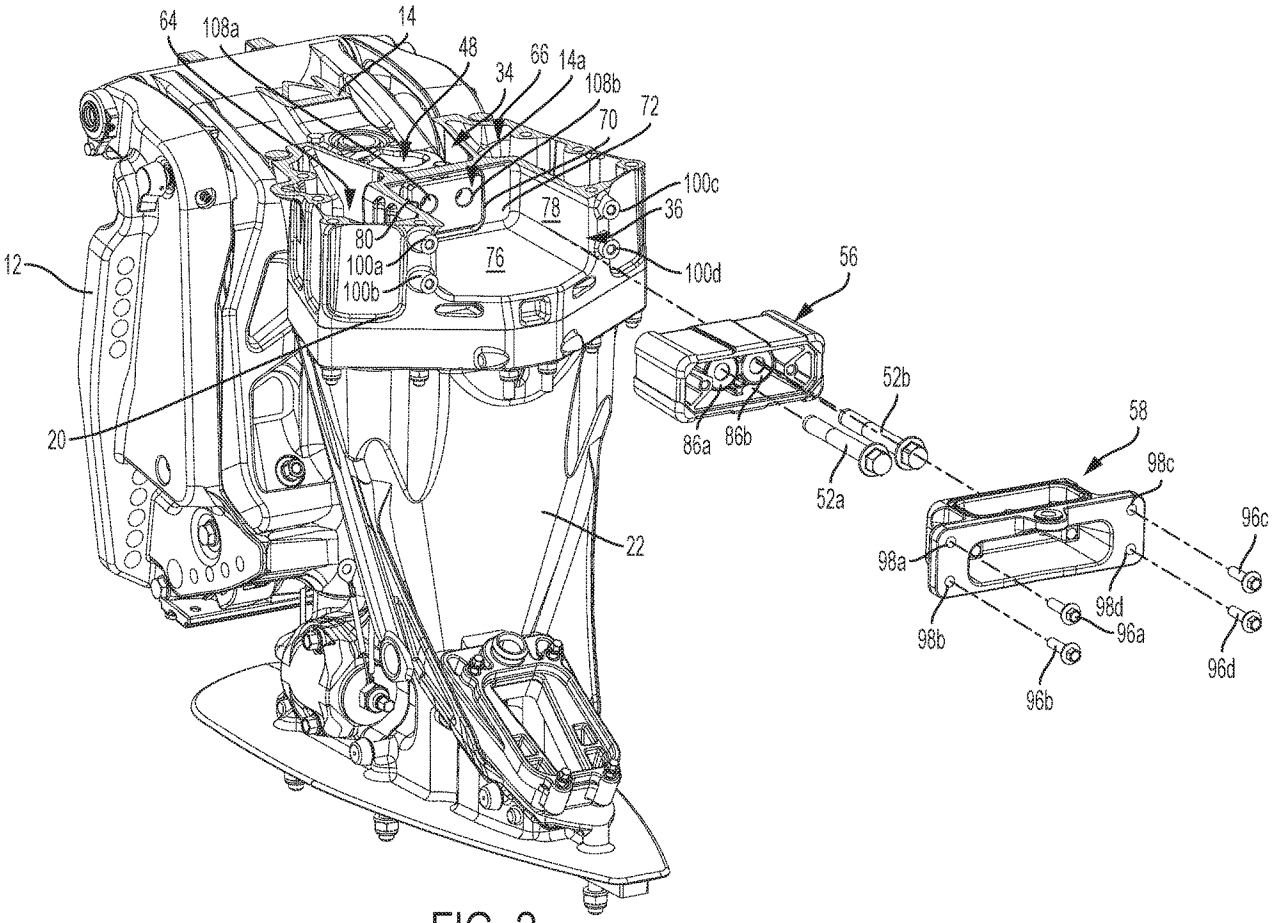
FIG. 2 illustrates a top cutaway view of the assembly of FIG. 1.
Figure 3:
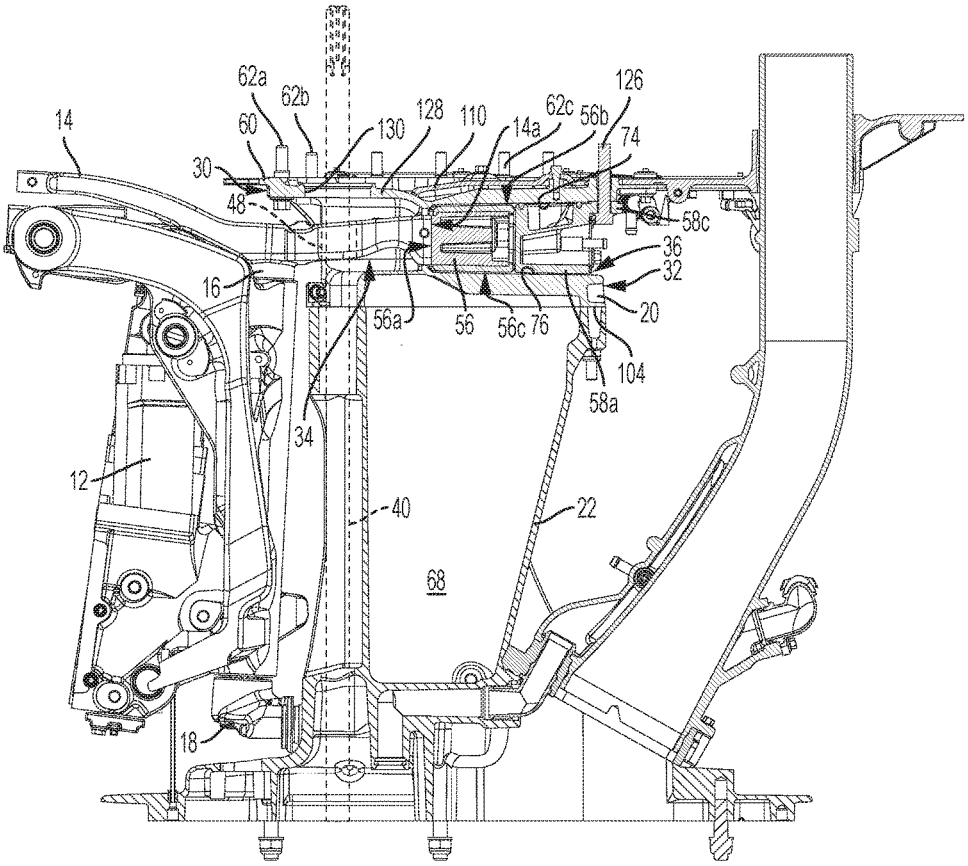
FIG. 3 illustrates a cross-sectional view of the assembly of FIG. 1.

FIGS. 1-8 illustrate a first embodiment of a mounting arrangement for the outboard motor 10, including a first embodiment of a mount 56. Although only the adapter plate 20, transom bracket 12, and midsection housing 22 are shown in FIGS. 1-4, it should be understood that the engine 26 and propulsion unit 38 of FIG. 11 would be provided therewith. The views of the mounting arrangement in FIGS. 1 and 2 are from the aft side of the outboard motor 10 and therefore illustrate the second pocket 36 into which the mount 56 extends. The cover plate 58 that is attached to the adapter plate's aft side 32 and secures the mount 56 within the second pocket 36 is also illustrated. It can be seen that the cover plate 58 is attached to the adapter plate's aft side 32 below an upper rim 60 of the adapter plate 20. (This upper rim 60 defines the adapter plate's upper surface 24 referred to in FIG. 11.) The cylinder block 51 of the engine 26 can be attached directly to the adapter plate's upper rim 60 by way of a plurality of fasteners, some of which are noted herein at 62*a*-62*c*. The adapter plate 20 defines oil drainage passageways 64, 66 extending along opposite port and starboard sides of the first and second pockets 34, 36. Referring also to FIG. 3, the midsection housing 22 may define an oil sump 68, which collects oil that drains from the cylinder block 51 and through the oil drainage passageways 64, 66.

Figure 4:
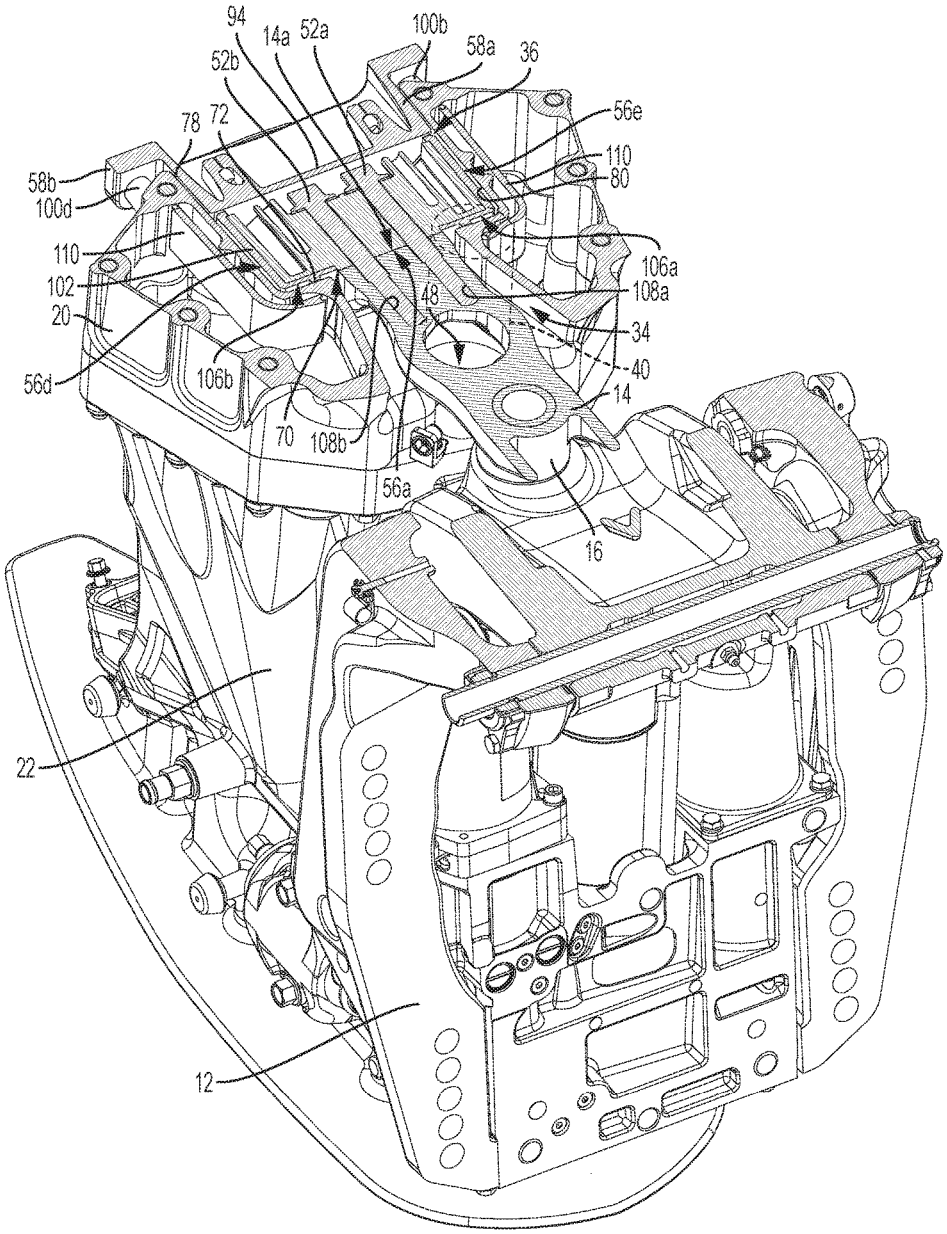
FIG. 4 illustrates a top cutaway view of the assembly from a different perspective than that of FIG. 2.

Referring specifically to FIGS. 2 and 4, it can be seen that the hole 48 in the steering arm 14 is generally cylindrical and is coaxial with the driveshaft 40. This ensures that the steering arm 14 has structural integrity, and that the hole 48 is no bigger than it needs to be to allow for passage of the driveshaft 40 therethrough. Additionally, by providing a hole 48 in the steering arm 14, as opposed to using a pronged or forked steering arm that extends on either side the driveshaft 40, it can be ensured that the entire aft end 14*a* of the steering arm 14 will be connected to the fore side 56*a* of the mount 56 by way of the connectors 52*a*, 52*b*, thereby enhancing vibration isolation. In fact, as shown in FIGS. 3 and 4, the steering arm's aft end 14*a* directly abuts the mount's fore side 56*a*. Direct abutment between the two parts is provided by way of the first pocket 34 and the second pocket 36 being connected by an aperture 70 in a fore surface 72 of the second pocket 36 (or, put another way, at the aft end of the first pocket 34). In other examples, an aft wall of the first pocket 34 or a separate plate could be provided between these two surfaces.

Now to turning to FIGS. 5-8, several features of the mount 56 and cover plate 58 will be described. The mount 56 has the above-noted fore side 56*a*, an upper side 56*b*, a lower side 56*c*, laterally opposite sides 56*d*, 56*e*, and an aft side 56*f*. The mount 56 has a main body 82 made of a non-elastomeric substance, such as aluminum or another light-weight metal. The main body 82 comprises an open box-shaped housing 84 supporting a pair of hollow cylinders 86*a*, 86*b* therein by way of support webs 88*a*-88*d*. The hollow cylinders 86*a*, 86*b* extend in the fore-aft direction of the outboard motor 10 and have respective bolt holes 87*a*, 87*b* that respectively accommodate the connectors 52*a*, 52*b* therein. Each support web 88*a*-88*d* extends at about a 45-degree angle from a respective corner of the box-shaped housing 84, inwardly toward the pair of hollow cylinders 86*a*, 86*b*. The support webs 88*a*, 88*b* have internal ends that are integral with one another and through which a threaded hole 90*a* extends in the fore-aft direction. The support webs 88*c*, 88*d* have internal ends that are integral with one another and through which a threaded hole 90*b* extends in the fore-aft direction. The threaded holes 90*a*, 90*b* are configured to receive a removal tool (not shown) that can be used to extract the mount 56 from the second pocket 36. In another example, no threaded holes 90*a*, 90*b* are provided, and the hollow cylinders 86*a*, 86*b* may instead have threaded bolt holes 87*a*, 87*b* for insertion of the removal tool. The hollow cylinders 86*a*, 86*b* end at a generally rectangular center section 84*a* of the box-shaped housing 84 of the mount 56 on its aft side 56*f*, which provides strength to the mount 56. The outer corners 84*b*-84*e* of the box-shaped housing 84 are rounded in order to provide room for a thicker elastomeric coating 102 (described below) at the outer corners 84*b*-84*e* if desired, and in order to prevent stress concentrations in the corners of the second pocket 36, which corners can also have large radii.

Figure 5:
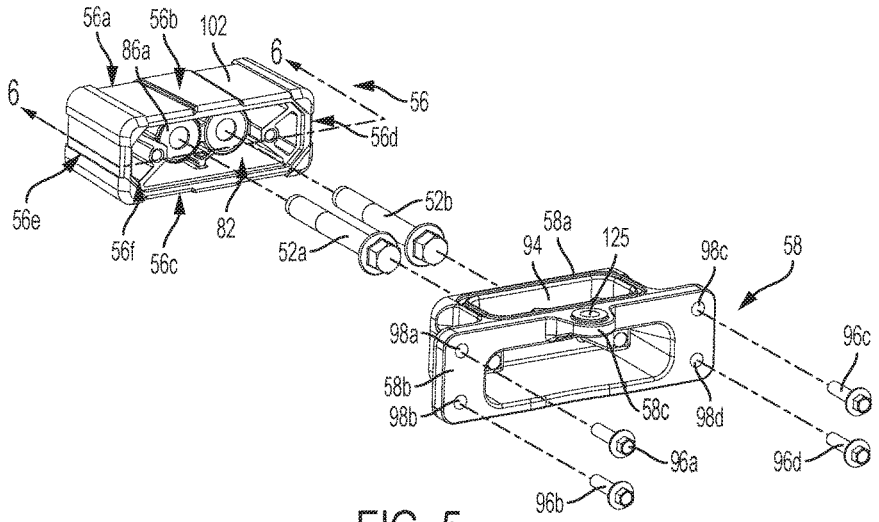
FIG. 5 illustrates an exploded view of one example of a mount and a cover plate according to the present disclosure.
Figure 6:
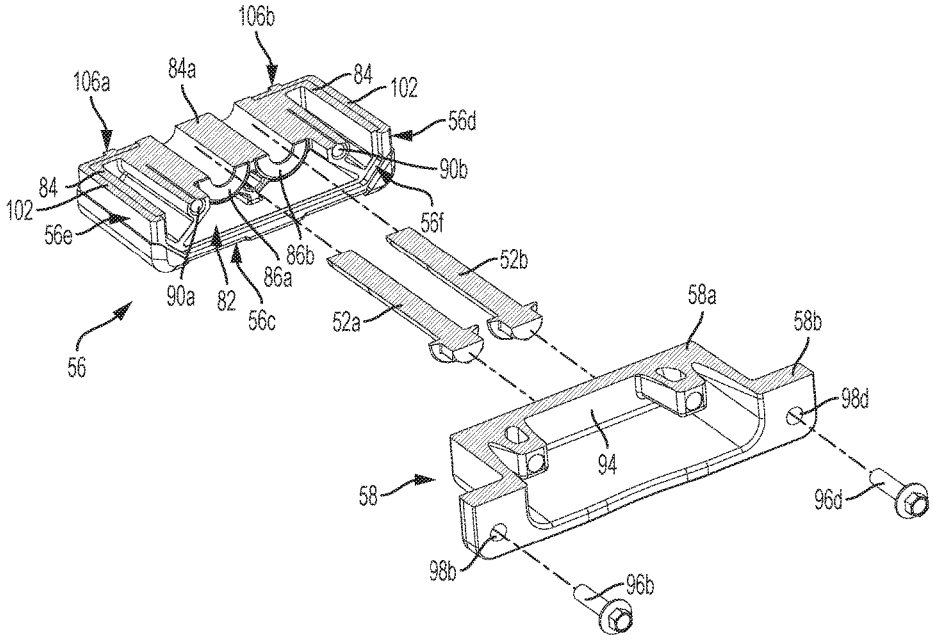
FIG. 6 illustrates a cross-sectional view along the dashed line 6-6 of FIG. 5.
Figure 7:
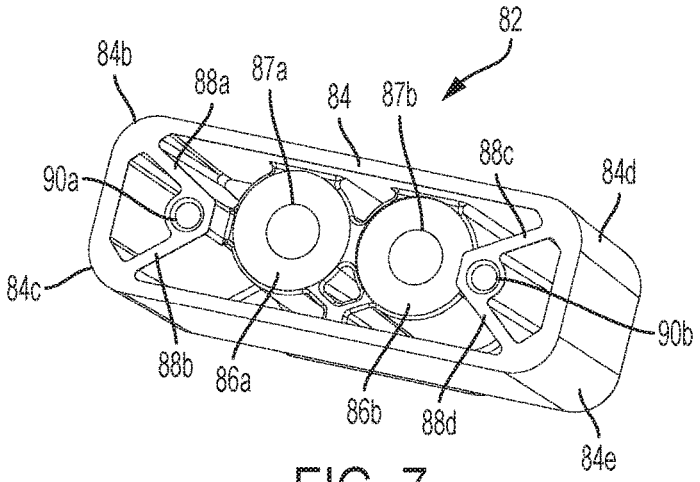
FIG. 7 illustrates a rear perspective view of a portion of the mount of FIG. 5.
Figure 8:
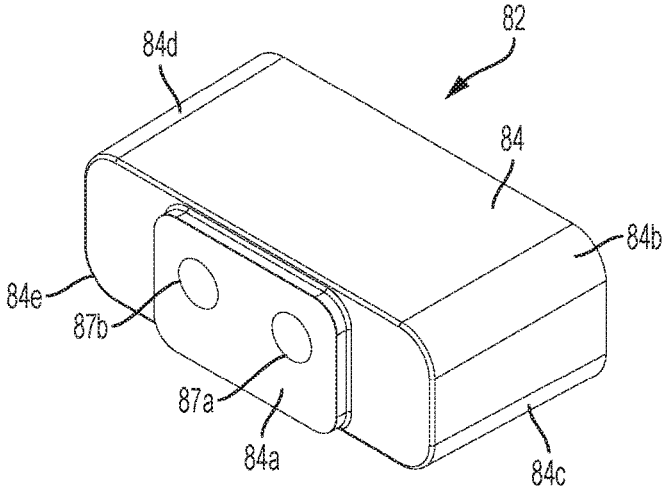
FIG. 8 illustrates a front perspective view of the portion of the mount of FIG. 7.

Referring to FIGS. 5 and 6, the mount 56 may further include the above-noted elastomeric coating 102 on an outer surface of the box-shaped housing 84. The elastomeric coating 102 may be only a few millimeters thick, such as about 1 millimeter to about 10 millimeters thick. The elastomeric coating 102 can be made of synthetic or natural rubber or another type of elastomer capable of withstanding high temperatures. The elastomeric coating 102 also provides some protection for the mount 56 and for the inner surfaces of the second pocket 36 in the adapter plate 20, preventing the aluminum adapter plate 20 from rubbing against the aluminum main body 82 of the mount 56.

Still referring to FIGS. 5 and 6, the cover plate 58 includes a box-shaped fore section 58*a*, which fits into the second pocket 36 (see FIGS. 3 and 4). A rear wall 94 of the box-shaped fore section 58*a* defines the cover plate's fore surface. The cover plate 58 also includes a flanged aft section 58*b* connected to the box-shaped fore section 58*a*. The flanged aft section 58*b* is located outside the second pocket 36 when the cover plate 58 is installed on the adapter plate 20 (see FIG. 4). Fasteners 96*a*-96*d* extend through apertures 98*a*-98*d* in the flanged aft section 58*b* and into the adapter plate's aft side 32. For example, referring to FIGS. 1 and 2, the fasteners 96*a*-96*d* may fit into receiving bores 100*a*-100*d* formed on the aft side 32 of the adapter plate 20.

Referring back to FIGS. 2-4, the adapter plate 20 defines an upper surface 74, a lower surface 76, two side surfaces 78, 80, and the fore surface 72 of the second pocket 36. As shown in FIGS. 2-4, and with reference also to FIGS. 5-6, the upper side 56*b* of the mount 56 is immediately adjacent the second pocket's upper surface 74. The lower side 56*c* of the mount 56 is immediately adjacent the second pocket's lower surface 76. The laterally opposite sides 56*d*, 56*e* of the mount 56 are immediately adjacent the second pocket's two side surfaces 78, 80 respectively. The aft side 56*f* of the mount 56 is immediately adjacent the fore surface (rear wall 94) of the cover plate 58. For example, each of these immediately adjacent surfaces may be touching one another or within millimeters of one another such that two or more of the surfaces touch when the outboard motor is subjected to force, and thus also allowing for manufacturing tolerances. Additionally, laterally opposite ends 106*a*, 106*b* of the mount's fore side 56*a* (see also FIG. 6) are immediately adjacent the second pocket's fore surface 72, as the aperture 70 in the fore surface 72 of the second pocket 36 is less wide than the mount 56. In one example, the mount 56 may be about seven inches wide along its fore side 56*a*. Because the mount 56 extends all the way to the front corners of the second pocket 36 and contacts the adapter plate 20 at the side surfaces 78, 80 (FIG. 4), good yaw stiffness is provided for the outboard motor 10. Note that only the thin elastomeric coating 102 separates the main body 82 from the second pocket's fore surface 72 at these opposite ends 106*a*, 106*b* of the mount's fore side 56*a*. In contrast, no elastomeric coating is provided on the generally rectangular center section 84*a* of the box-shaped housing 84, where the mount 56 is directly connected to the steering arm 14. When the cover plate 58 is sealed over the mount 56 within the second pocket 36, the mount 56 is trapped on all six sides by the surfaces 72, 74, 76, 78, 80 of the second pocket 36, the aft end 14*a* of the steering arm 14, and the rear wall 94 of the cover plate 58. In fact, the cover plate 58 compresses the mount 56 slightly so that the mount 56 is tight within the second pocket 36.

With reference to FIGS. 2 and 4, to install the mount 56, the mount 56 can be inserted into the second pocket 36 from the aft side 32 of the adapter plate 20. The connectors 52*a*, 52*b* can then be inserted through the hollow cylinders 86*a*, 86*b*. The steering arm's aft end 14*a* comprises a pair of forwardly extending bore holes 108*a*, 108*b*, which respectively accommodate the connectors 52*a*, 52*b* therein. The bore holes 108*a*, 108*b* may be threaded to receive the threaded connectors 52*a*, 52*b*. After these connectors 52*a*, 52*b* are tightened within the bore holes 108*a*, 108*b*, the cover plate 58 may be provided over the mount 56. The box-shaped fore section 58*a* is inserted into the second pocket 36, and the flanged aft section 58*b* is secured to the aft side 32 of the adapter plate 20 by way of fasteners 96*a*-96*d* inserted through apertures 98*a*-98*d* and into threaded receiving bores 100*a*-100*d*. Referring to FIGS. 3 and 5, an additional fastener 126 can be inserted through a hole 125 extending vertically through a horizontal tab 58*c* on the cover plate 58 in order to further connect the flanged aft section 58*b* to the adapter plate 20 and even to the cylinder block 51.

The mount 56 can easily be removed for servicing by removing the fasteners 126 and 96*a*-96*d* from the flanged aft section 58*b* of the cover plate 58 and thereafter removing the cover plate 58 from the second pocket 36. The connectors 52*a*, 52*b* can then be removed from the hollow cylinders 86*a*, 86*b* and from the bore holes 108*a*, 108*b* in the steering arm 14, after which the mount 56 can be removed from the second pocket 36 with the aid of the removal tool inserted into threaded holes 90*a*, 90*b*. Such servicing, because access to the cover plate 58 and mount 56 is from the aft side of the outboard motor 10, can be done easily and without removing the cylinder block 51 from the adapter plate 20.

Figure 9:
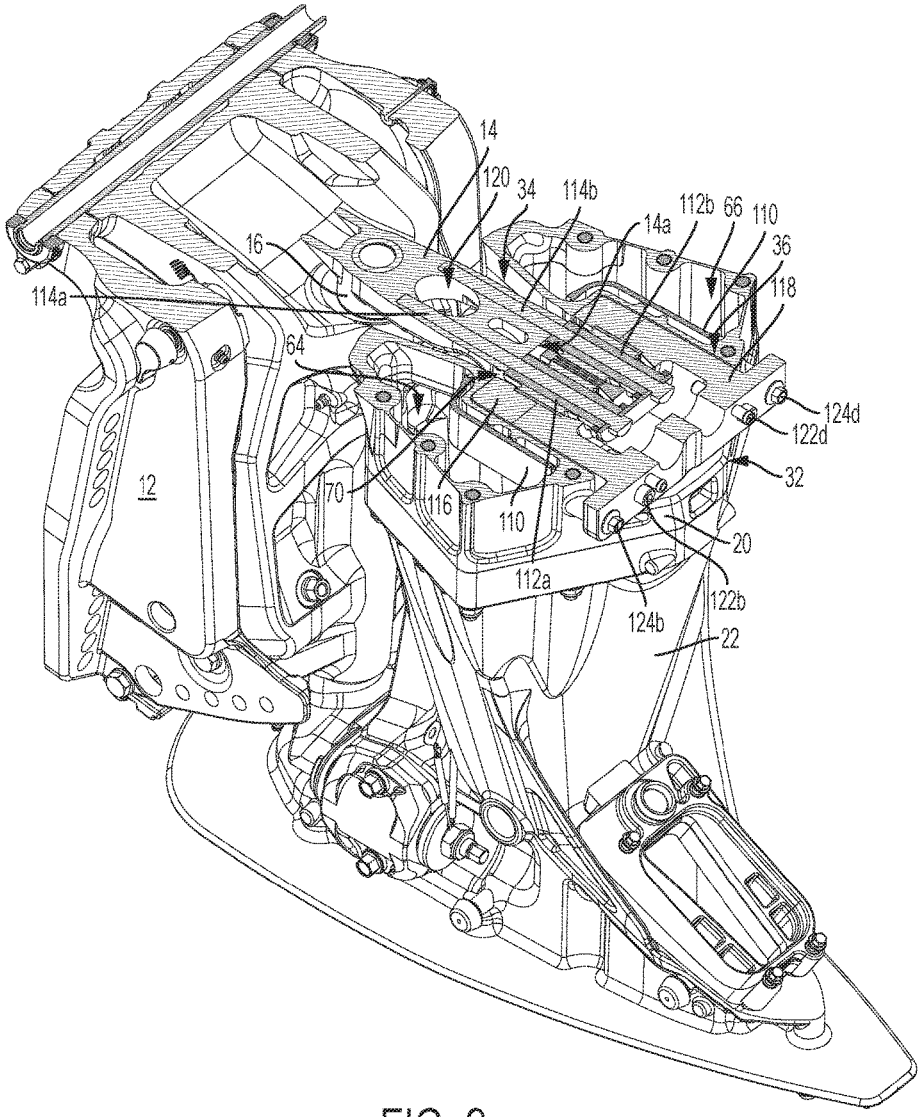
FIG. 9 illustrates a cutaway view of another embodiment of an outboard motor mounting assembly according to the present disclosure.
Figure 10:
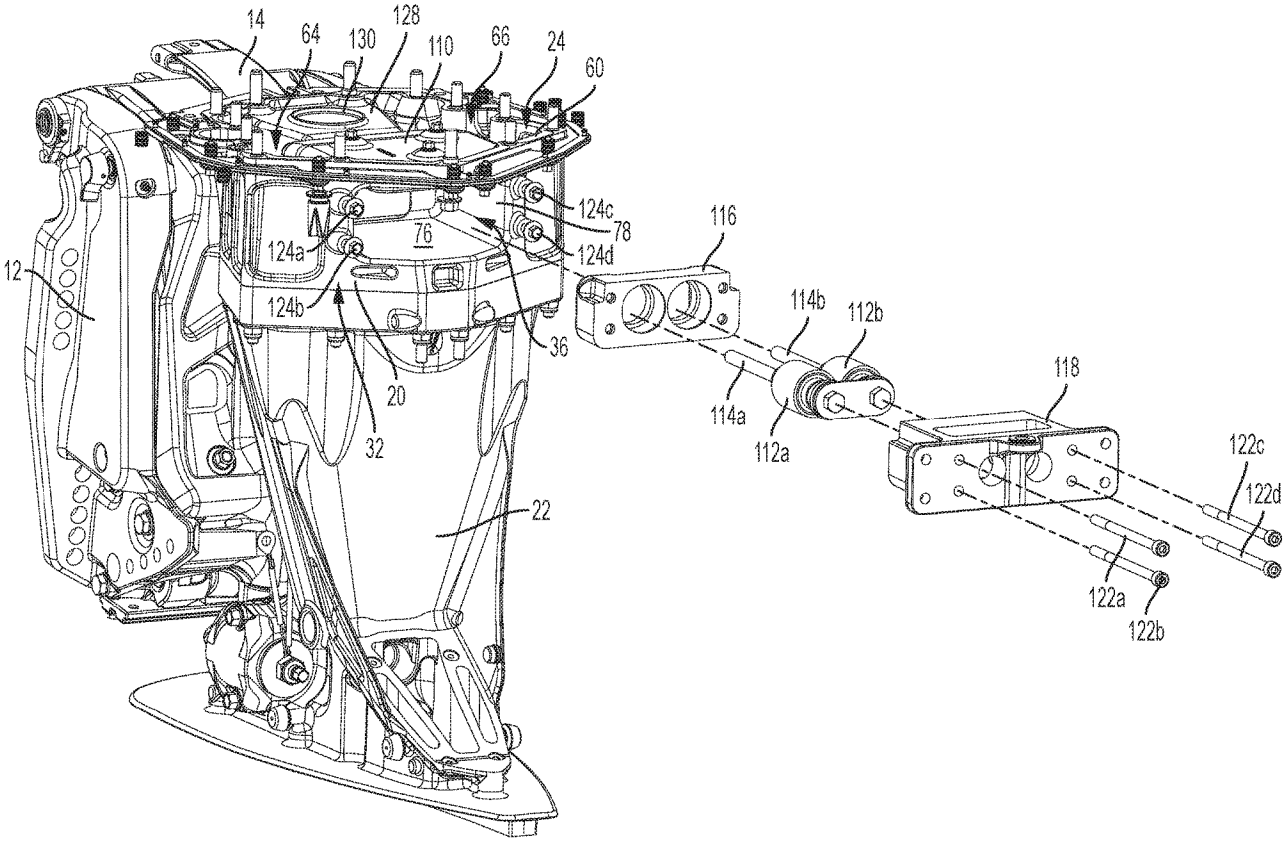
FIG. 10 illustrates a partially exploded view of the assembly of FIG. 9.

FIGS. 9 and 10 illustrate a second embodiment of a mounting arrangement for an outboard motor 10 according to the present disclosure. Components that are the same as those of the first embodiment are labeled with the same reference numbers, and will not be described further herein. In this embodiment, the mount includes two conventional tubular mounts 112*a*, 112*b*. The mounts 112*a*, 112*b* are attached to the aft end 14*a* of the steering arm 14 by way of threaded connectors 114*a*, 114*b*. A locating block 116 with cylindrical apertures for accommodating the mounts 112*a*, 112*b* is provided just fore of the cover plate 118, and positions the mounts 112*a*, 112*b* and the cover plate 118 within the second pocket 36. In this example, because the connectors 114*a*, 114*b* are slightly longer than those in the first example, the hole 120 in the steering arm is ovular, rather than cylindrical. The mounting assembly further includes fasteners 122*a*-122*d* for securing the cover plate 118 to the locating block 116 and fasteners 124*a*-124*d* for securing the cover plate 118 to the aft side 32 of the adapter plate 20.

Thus, the present disclosure is of an adapter plate 20 having an upper rim 60 configured to support an engine 26; a lower rim 104 (FIG. 3) spaced from the upper rim 60 and configured to be coupled to a midsection housing 22; and a fore side 30 and an aft side 32 connecting the upper rim 60 and the lower rim 104. A first pocket 34 is defined in the adapter plate's fore side 30, and a second pocket 36 is defined in the adapter plate's aft side 32. The second pocket 36 has an upper surface 74, a lower surface 76, two side surfaces 78, 80 and a fore surface 72 defined by the adapter plate 20. The first pocket 34 and the second pocket 36 are connected by an aperture 70 in the second pocket's fore surface 72. A steering arm 14 extends into the first pocket 34. The steering arm 14 has a hole 48 or 120 that allows a driveshaft 40 of the outboard motor 10 to extend through the steering arm 14. A mount 56 or 112*a*, 112*b* is situated in the second pocket 36. The mount 56 or 112*a*, 112*b* is located aft of the hole 48 or 120 and a fore side (e.g., 56*a*) of the mount 56 or 112*a*, 112*b* directly abuts an aft end 14*a* of the steering arm 14 via the aperture 70 and is attached to the steering arm's aft end 14*a* by way of connectors 52*a*, 52*b* or 114*a*,

114*b*. A cover plate 58 or 118 is attached to the adapter plate's aft side 32 below the adapter plate's upper rim 60 and secures the mount 56 or 112*a*, 112*b* within the second pocket 36. Because the mount 56 or 112*a*, 112*b* is located aft of the driveshaft 40, it is able to be placed near the center of gravity 54 of the engine 26.

Referring to FIGS. 3, 4, 9, and 10, the outboard motor 10 and mounting arrangement of the present disclosure may further include a heat shield 110 between the cylinder block 51 and the second pocket 36 that at least partially thermally isolates the mount 56 or 112*a*, 112*b* from oil that drains from the cylinder block 51 into the oil drainage passageways 64, 66. Further details of such a heat shield 110 are described in U.S. Pat. No. 9,463,859, and will not be further discussed herein. A casting wall 128 of the adapter plate 20, which has a driveshaft passageway 130 therein, may further define the oil drainage passageways 64, 66 through the adapter plate 20.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other assemblies. It is to be expected that various equivalents, alternatives and modifications are possible within the scope of the appended claims. Each limitation in the appended claims is intended to invoke interpretation under 35 USC § 112(f), only if the terms "means for" or "step for" are explicitly recited in the respective limitation.

What is claimed is:

1. An outboard motor comprising:

an adapter plate having an upper surface configured to support an engine, a lower surface spaced from the upper surface, and a fore side and an aft side connecting the upper surface and the lower surface, wherein a pocket is defined in the adapter plate's aft side;

a midsection housing coupled to the lower surface of the adapter plate and configured to suspend a propulsion unit therebelow;

a driveshaft extending through the adapter plate, the driveshaft having an upper end configured to be coupled to an output shaft of the engine and a lower end configured to be coupled to a propulsion shaft of the propulsion unit;

a mount situated in the pocket, wherein the mount is located aft of the driveshaft;

a steering arm having a hole through which the driveshaft extends, wherein a fore side of the mount is coupled to an aft end of the steering arm by way of connectors; and a cover plate attached to the adapter plate's aft side and securing the mount within the pocket.

2. The outboard motor of claim 1, wherein the hole in the steering arm is cylindrical and coaxial with the driveshaft.

3. The outboard motor of claim 2, wherein the adapter plate defines an upper surface, a lower surface, two side surfaces, and a fore surface of the pocket.

4. The outboard motor of claim 3, further comprising an aperture in the pocket's fore surface.

5. The outboard motor of claim 4, wherein the steering arm's aft end directly abuts the mount's fore side.

6. The outboard motor of claim 1, wherein the cover plate is attached to the adapter plate's aft side below an upper rim of the adapter plate, and the upper rim defines the adapter plate's upper surface.

7. The outboard motor of claim 6, wherein the engine is a V-shaped engine having a cylinder block that is attached directly to the adapter plate's upper rim.

8. The outboard motor of claim 7, wherein the engine is a four-stroke engine.

9. The outboard motor of claim 7, wherein the adapter plate defines oil drainage passageways extending along port and starboard sides of the pocket, and the midsection housing defines an oil sump.

10. The outboard motor of claim 9, further comprising a heat shield between the cylinder block and the pocket that at least partially thermally isolates the mount from oil that drains from the cylinder block into the oil drainage passageways.

11. The outboard motor of claim 1, wherein the mount comprises a main body made of a non-elastomeric substance, the main body comprising an open box-shaped housing supporting a pair of hollow cylinders therein by way of support webs, the pair of hollow cylinders extending in a fore-aft direction of the outboard motor and respectively accommodating the connectors therein.

12. The outboard motor of claim 11, wherein the mount further comprises an elastomeric coating on an outer surface of the box-shaped housing.

13. A mounting arrangement for an outboard motor, the mounting arrangement comprising:

an adapter plate having an upper rim configured to support an engine, a lower rim spaced from the upper rim and configured to be coupled to a midsection housing, and a fore side and an aft side connecting the upper rim and the lower rim;

wherein a first pocket is defined in the adapter plate's fore side, and a second pocket is defined in the adapter plate's aft side;

wherein the second pocket has an upper surface, a lower surface, two side surfaces, and a fore surface defined by the adapter plate; and wherein the first pocket and the second pocket are connected by an aperture in the second pocket's fore surface;

a steering arm extending into the first pocket and terminating at an aft end;

a mount situated in the second pocket, wherein a fore side of the mount directly abuts the aft end of the steering arm via the aperture and is attached to the steering arm's aft end by way of connectors; and a cover plate attached to the adapter plate's aft side below the adapter plate's upper rim and securing the mount within the second pocket.

14. The mounting arrangement of claim 13, wherein:

an upper side of the mount is immediately adjacent the second pocket's upper surface;

a lower side of the mount is immediately adjacent the second pocket's lower surface;

laterally opposite sides of the mount are immediately adjacent the second pocket's two side surfaces, respectively;

an aft side of the mount is immediately adjacent a fore surface of the cover plate; and laterally opposite ends of the mount's fore side are immediately adjacent the second pocket's fore surface.

15. The mounting arrangement of claim 14, wherein the cover plate comprises:

a box-shaped fore section fitting into the second pocket, a rear wall of the box-shaped fore section defining the cover plate's fore surface;

a flanged aft section connected to the box-shaped fore section and located outside the second pocket; and a plurality of fasteners extending through apertures in the flanged aft section and into the adapter plate's aft side.

16. The mounting arrangement of claim 13, wherein the mount comprises a main body made of a non-elastomeric substance, the main body comprising an open box-shaped housing supporting a pair of hollow cylinders therein by way of support webs, the pair of hollow cylinders extending in a fore-aft direction of the outboard motor and respectively accommodating the connectors therein.

17. The mounting arrangement of claim 16, wherein the mount further comprises an elastomeric coating on an outer surface of the box-shaped housing.

18. The mounting arrangement of claim 17, wherein the elastomeric coating is about 1 millimeter to about 10 millimeters thick.

19. The mounting arrangement of claim 13, wherein the adapter plate defines oil drainage passageways extending along laterally opposite sides of the first and second pockets.

20. The mounting arrangement of claim 13, wherein the steering arm's aft end comprises a pair of forwardly extending bore holes respectively accommodating the connectors therein.

* * * * *